United States Patent [19]

Sekigawa et al.

[11] Patent Number: 4,984,392

[45] Date of Patent: Jan. 15, 1991

[54] CHAMFERING THE NOTCH OF A SEMICONDUCTOR WAFER

[75] Inventors: Toshio Sekigawa; Kenichi Yoshihara, both of Niigata, Japan

[73] Assignee: Shin-Etsu Handotai Company Limited, Tokyo, Japan

[21] Appl. No.: 413,406

[22] Filed: Sep. 27, 1989

Related U.S. Application Data

[62] Division of Ser. No. 255,161, Sep. 29, 1988, Pat. No. 4,905,425.

[51] Int. Cl.[5] ..... B24B 49/00

[52] U.S. Cl. ..... 51/165.77; 51/98 R

[58] Field of Search ..... 51/98 R, 165.77, 165.9, 51/281 R, 283 R, 283 E, 284 R, 284 E

[56] References Cited

U.S. PATENT DOCUMENTS

| | | | |
|---|---|---|---|
| 342,789 | 6/1886 | Fenton | 51/98 R |
| 1,133,515 | 3/1915 | Uhlemann | 51/98 R |
| 1,196,294 | 8/1916 | Sanderson | 51/98 R |
| 1,282,022 | 10/1918 | Baker et al. | 51/98 R |
| 2,971,408 | 2/1961 | Robinson | 51/98 R |
| 4,800,686 | 1/1989 | Hirabayashi | 51/283 R |

FOREIGN PATENT DOCUMENTS 6223951 7/1987 Japan .

*Primary Examiner*—Frederick R. Schmidt
*Assistant Examiner*—M. Rachuba
*Attorney, Agent, or Firm*—Lowe, Price, LeBlanc, Becker and Shur

[57] ABSTRACT

A notch-cut semiconductor wafer whose notch has its both corners entirely chamfered, and an apparatus and method for chamfering the notch as such, which employs a positioning device for positioning the wafer such that the notch of the wafer points in a predetermined direction; a conveyor device for conveying the wafer to a chamfering position; a holding device for holding the wafer to bring the wafer to arbitrary places; an abrasive wheel having an edge which is shaped like the notch; a driving device for driving the abrasive wheel; and a mechanism for controlling moving at least one of the two items consisting of the abrasive wheel and the semiconductor wafer, to arbitrary places.

3 Claims, 9 Drawing Sheets

CHAMFERING THE NOTCH OF A SEMICONDUCTOR WAFER

This application is a division of application Ser. No. 07/255,161 filed Sept. 29, 1988 now U.S. Pat. No. 4,905,425.

BACKGROUND OF THE INVENTION

The present invention relates to a semiconductor wafer with a notch cut in the periphery, and a method and an apparatus for chamfering the notch. A semiconductor wafer used as the substrate for semiconductor device such as semiconductor integrated circuit is commonly made in the following manner: a monocrystal rod (ingot) of silicon, for example, is sliced in the direction normal to the axis of the rod and then each round slice is subjected to lapping, etching, polishing, and other finishing treatments as the need arises. It is a normal practice to provide an orientation flat at a portion of the periphery of the wafer for the purpose of allowing one to know at a glance the direction of crystal orientation as well as facilitating the positioning of optical pattern. Since the orientation flat is provided by cutting away an arch portion from the periphery of the wafer, the cut away piece is sacrificed so that the number of effective chips obtained from a wafer is less than it would otherwise be.

In order to avoid the sacrificial cutting away of the wafer, it was proposed (e.g. in Japanese Pat. Application No. 62-239517) to provide a small notch (commonly V-shaped or U-shaped) in the periphery of the semiconductor wafer in a manner such that the notch is effective of providing a guide for positioning of the optical pattern as well as of indicating the direction of crystal orientation.

Monocrystal silicon, GGG, and lithium tantalate, and the like of which semiconductor wafers are often made, are very hard and brittle and easy to break in the direction of crystal orientation. In these days, the processes for manufacturing wafers and those for manufacturing devices are mostly automatized, and in these automatized processes the wafers are shifted along the process lines incessantly with some possibility of collision and receiving physical shocks so that unless the peripheral edges of the wafers are chamfered the edges of the wafers are chipped, and the infinitesimal chips dropping from the wafers are responsible together with dust in the air for lowering of the properties of the device and hence to increasing in number of off-specification devices produced. Therefore, it has been conventionally practiced to chamfer the periphery of semiconductor wafer including the portion where orientation flat is formed.

However, in the case of the semiconductor wafers provided with a notch in the periphery, chamfering was not applied to the notch portion of the periphery, so that when the notch is brought in engagement with a positioning pin in a device manufacturing process, the likelihood is that the unchamfered notch is chipped and gives away infinitesimal chips to give rise to the problems described above.

SUMMARY OF THE INVENTION

The present invention, therefore, was contrived with the view of solving these problems, and in particular, the invention provides a semiconductor wafer with a notch which resists collisions without being chipped.

It is also an object of the invention to provide a method and apparatus that renders the notch resistible to physical shocks such as collisions. In particular, the invention proposes a method and apparatus useful to effectively chamfer the notch provided at a periphery of a semiconductor wafer.

In order to attain the above and other objects, the inventors studied the related mechanism and came to attain the objects through employment of a method and apparatus with which it is possible to chamfer the entire notch from either side of the wafer.

More particularly, the method according to the invention is characterized in that it involves a semiconductor wafer with a notch having unchamfered corners on both sides and an abrasive wheel having an edge (swell) which is shaped like the notch when seen in a cross section taken on a plane containing the axis of rotation of the abrasive wheel, the edge angle of the edge of the abrasive wheel being such that the edge can fit on one corner of the notch when the edge is brought in contact with the notch in a manner that the axis of rotation of the abrasive wheel is either higher or lower than the plane in which the wafer lies by a predetermined elevation (height); and the method is further characterized by including the following steps: (i) the semiconductor wafer with the notch and the abrasive wheel having the above-mentioned edge (swell) are first positioned to oppose each other in a manner such that the wafer is parallel with the axis of rotation of the abrasive wheel, that the center line of the notch of the wafer lies in the same plane as does the circle described by the edge of the abrasive wheel, and that the axis of rotation of the abrasive wheel comes above or below the plane including the wafer by predetermined elevation; (ii) the abrasive wheel is started to turn; (iii) the distance between the notch and the tip of the edge of the abrasive wheel is reduced until they come in contact with each other without altering the predetermined elevation between them (whereby the abrasive wheel chamfers that side corner of the notch where the abrasive wheel touches the notch); (iv) the edge of the abrasive wheel is caused to grind the notch by a predetermined amount; and (v) the steps (i), (ii), (iii), and (iv) are repeated again in the same manner except that the altitudinal relationship between the semiconductor wafer and the abrasive wheel is reversed (whereby the abrasive wheel chamfers the unchamfered corner of the notch).

Preferably, the step (iv) is conducted such that while the edge of the abrasive wheel is caused to grind the notch by a predetermined amount, the altitudinal difference between the wafer and the axis of rotation of the abrasive wheel is gradually increased at a rate such that the chamfer produced becomes flat. More particularly, the semiconductor wafer and/or the axis of rotation of the abrasive wheel is moved in such a manner that first they approach each other without altering they altitudinal difference, but that from the moment of contact between the notch and the edge of the abrasive wheel the altitudinal difference is increased such that the line traced by the axis of rotation of the abrasive wheel relative to the semiconductor wafer becomes a straight line which forms a predetermined acute angle with the plane of the wafer.

The apparatus for chamfering according to the invention is characterized in that it includes a positioning means for positioning a semiconductor wafer in a manner that the notch provided in the periphery of the semiconductor wafer points in a predetermined direction; a conveyor means for conveying the thus positioned wafer to a chamfering position; a holding means for holding the semiconductor wafer in the chamfering position to bring the wafer to arbitrary places; the afore-described abrasive wheel, the edge angle of the edge of the abrasive wheel being preferably slightly greater than the angle included in the notch; a driving means for driving the abrasive wheel; and a means for bringing the abrasive wheel to arbitrary places.

Designed as described above, the method and the apparatus according to the invention are effective to attain the following operation: the positioning means causes the semiconductor wafer to take a position where the wafer is horizontal and its notch points in the predetermined direction; the conveyor means conveys the semiconductor wafer to the chamfering position where the wafer stays in such a position that the horizontal plane wherein the wafer lies includes in it the axis of rotation of the wheel and that the center line of the notch of the wafer lies in the same plane as does the circle described by the edge of the abrasive wheel; then, the holding means raises the wafer by a predetermined elevation whereby the plane including the wafer comes above the axis of rotation of the wheel; the driving means drives the abrasive wheel to turn at a high speed; and the holding means brings the wafer horizontally toward the running edge of the abrasive wheel till the edge of the abrasive wheel grinds the lower side of the notch thereby providing chamfer along the lower corner of the notch. Next, the holding means brings the wafer back horizontally and then brings it below the level of the axis of rotation of the abrasive wheel, and again horizontally toward the running edge of the abrasive wheel whereby the upper corner of the notch is chamfered. Since the cross section of the edge of the abrasive wheel taken on a plane including the axis of rotation of the wheel is more or less shaped like the letter V having an edge angle slightly greater than the angle included in the notch, the edge of the abrasive wheel fittingly touches the entire corner of a side of the notch whereby the chamfering of the entire corner is carried out simultaneously.

Incidentally, if either the semiconductor wafer or the axis of rotation of the abrasive wheel is kept static during chamfering, as is the case with the abovementioned method wherein the latter was kept unmoved, the resulting chamfer on the notch becomes a concavity having a radius of curvature equal to the radius of the circle described by the edge of the abrasive wheel. If the semiconductor wafer and the axis of rotation of the abrasive wheel are both adjustably moved simultaneously in a certain manner during chamfering, it is possible to provide a flat chamfer.

The semiconductor wafer having its notch chamfered as described above can get in engagement with a positioning pin at its notch without being chipped so that no infinitesimal chips get in the manufacture line to spoil the quality of the products and therefore the occurrence rate of off-specification products is reduced.

DETAILED DESCRIPTION OF THE INVENTION

Referring to the attached drawings, the invention shall be described further in detail based on its embodiment.

Figure 1:
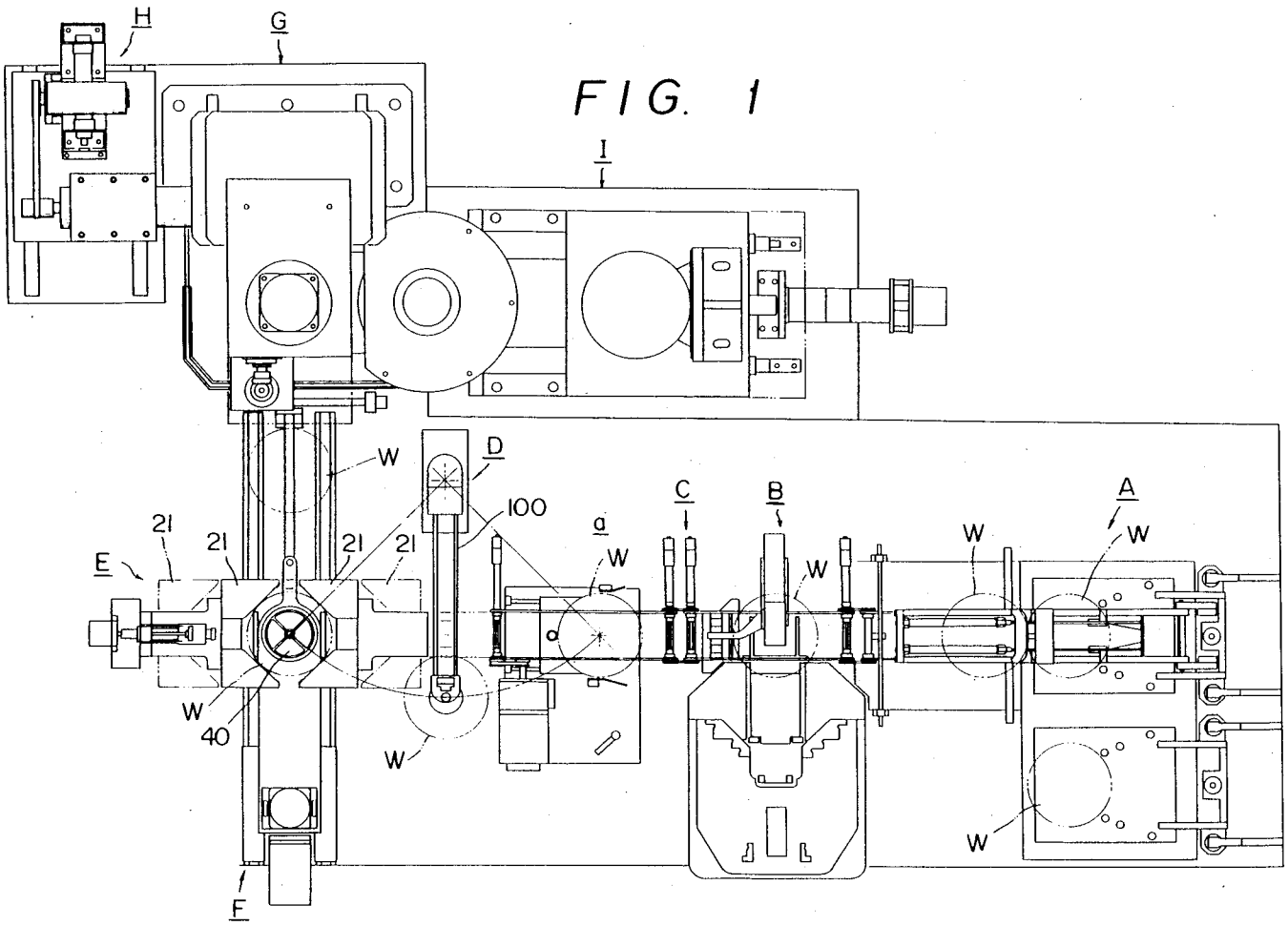
FIG. 1 is a top view of a notch chamfering apparatus to which the present invention is applied.

FIG. 1 shows the whole structure of an example of the apparatus for chamfering the notches of semiconductor wafers, seen from above, to which the present invention is applied. The chamfering apparatus comprises a wafer loader assembly A, a thickness measurement assembly B, an entrance conveyor assembly C, a handling arm assembly D, a wafer alignment assembly E, a wafer feeder assembly F, a work base assembly G, a notch chamfer assembly H, and a periphery chamfer assembly I. The principal parts of the chamfering apparatus, namely the wafer alignment assembly E, the wafer feeder assembly F, the work base assembly G, and the notch chamfer assembly H will be described in detail next.

Figure 2:
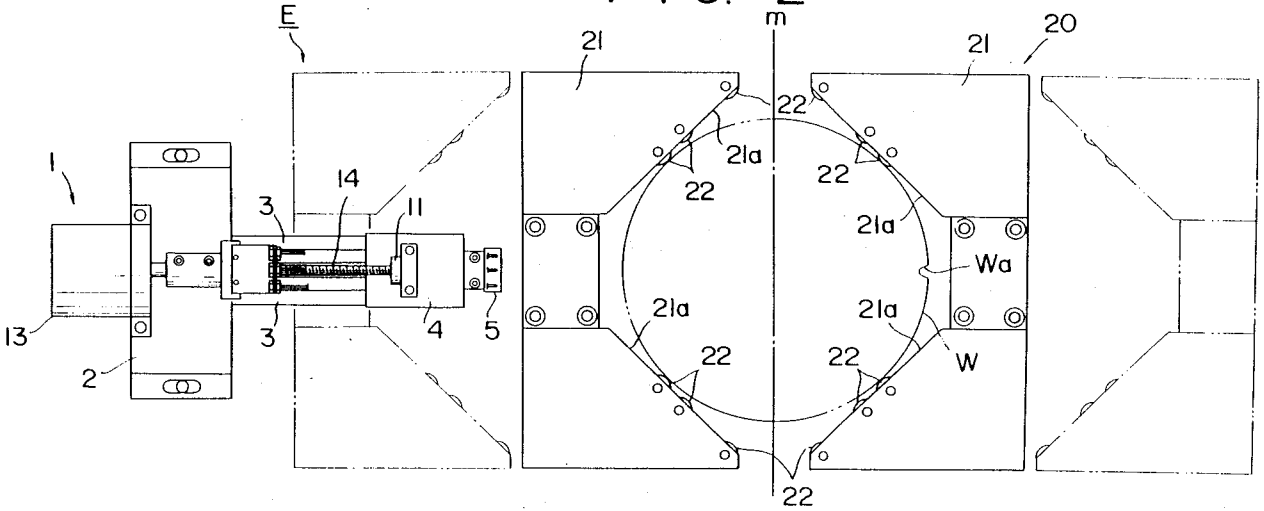
FIG. 2 is a top view of the wafer aligment assembly.
Figure 3:
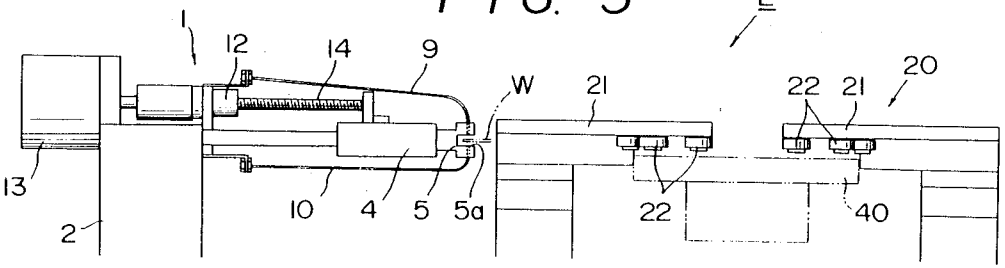
FIG. 3 is the side view of the wafer aligment assembly.

First, referring to FIGS. 2 and 3, the wafer alignment assembly E will be brought to light. FIG. 2 is the top view of the wafer alignment assembly E, and FIG. 3 is the side view of the same. Reference numeral 1 designates a notch detector which is horizontally provided on the top of a vertically standing base 2. A pair of parallel and horizontal guide bars 3, 3 are supported by and extending from the top of the base 2. A slider 4 is provided such that it can freely slide along the guide bars 3, 3. Provided in the forefront (right end as viewed in FIGS. 2 and 3) of the slider 4 is a sensor 5 which has a recess 5*a*. Three sensor elements (not shown) are vertically embedded in the part over the recess 5*a* of the sensor 5 and three sensor elements (not shown) are vertically embedded in the part below the recess 5*a* of the sensor 5 in such a manner that the center lines of the sensor elements in the upper part of the sensor 5 and those of the sensor elements in the lower part of the sensor 5 are collinear with each other (corresponding one to one). Each sensor element is connected to respective optical fiber 9 or 10.

A bearing 11 and a nut 12 are fixed on the slider 4. A motor 13 is fixed partially on the top of the base 2 and a screw bolt 14 as the drive shaft extends horizontally from the motor 13. The screw bolt 14 penetrates the nut 12 with which it is threadably engaged and one end of the screw bolt 14 is received by the bearing 11 such that it can freely rotate in the bearing 11.

Figure 4:
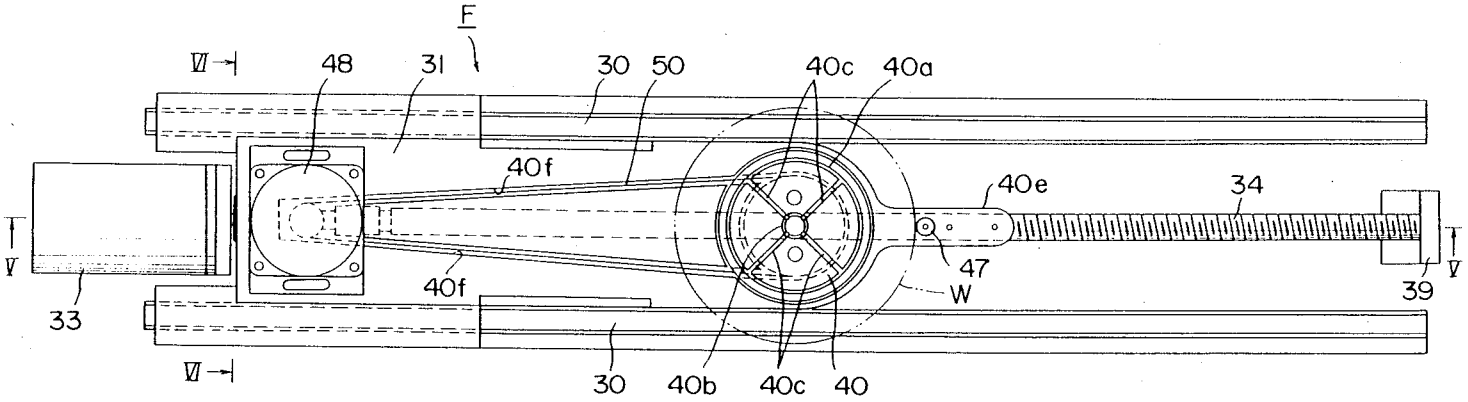
FIG. 4 is a top view of the wafer feeder assembly.
Figure 5:
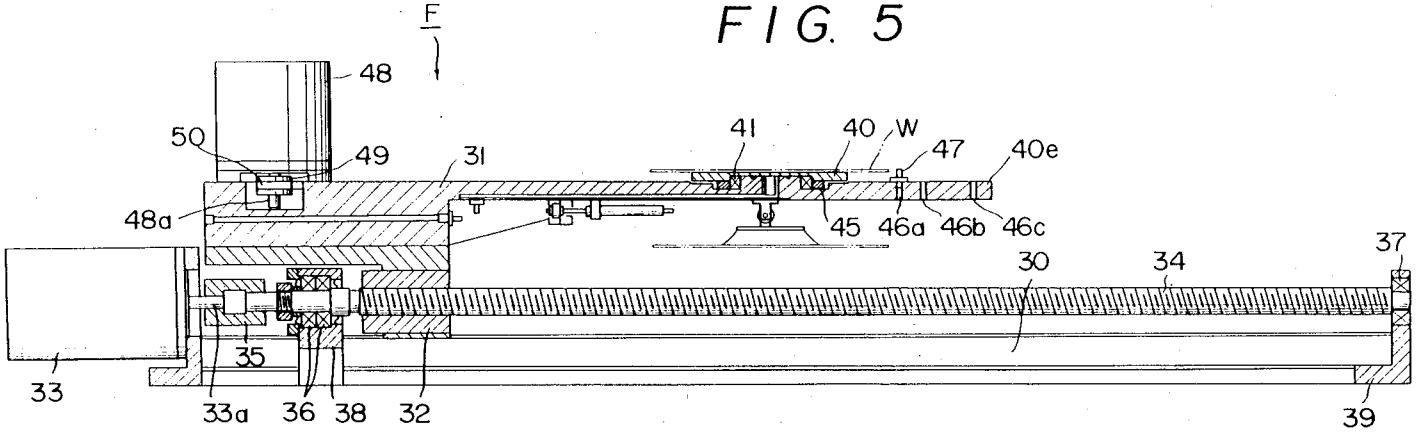
FIG. 5 is the cross section of the wafer feeder assembly taken on the line V—V in FIG. 4.
Figure 6:
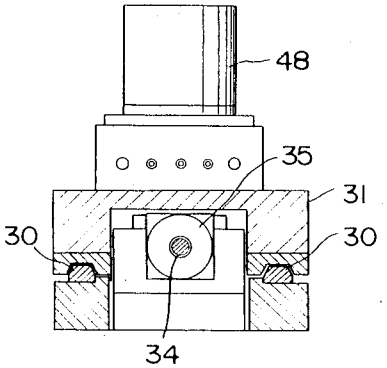
FIG. 6 is the cross section of the wafer feeder assembly taken on the line VI—VI in FIG. 4.

An alignment mechanism 20 is provided in the vicinity of the notch detector 1. The alignment mechanism 20 has a pair of aligners 21, 21 which are opposed to each other and capable of being caused by a drive means (not shown) to move simultaneously such that they are always symmetrical with respect to a one-dot chain line m in FIG. 2. The opposing faces 21*a*, 21*a* of the aligners 21, 21 are designed such that when seen from above the lines defined by the faces 21*a*, 21*a* constitute parts of an imaginary square, the size of the square being dependent on the positions of the aligners 21, 21. Along the faces 21*a*, 21*a* and underneath the aligners 21, 21 are provided freely rotatable rubber rollers 22, six rollers each for the respective aligner 21. Seen from the above, the rollers 22 are so arranged that only a small portion of the rubber peeps from the aligners 21, 21. Next, referring to FIGS. 4, 5, and 6, we will explain about the details of the wafer feeder assembly F. FIG. 4 is the top view of the wafer feeder assembly F; FIG. 5 is a cross section taken on the line V—V of FIG. 4; and FIG. 6 is a cross section taken on the line VI—VI of FIG. 4.

Reference numeral 30 designates a pair of rails extending toward the work base assembly G (see FIG. 1), and on these parallel rails 30, 30 runs a carriage 31. On the bottom of the carriage 31 is provided a nut 32 through which penetrates a screw bolt 34, which 34 has its one end connected to the drive shaft 33*a* of a motor 33 via a coupling 35. The screw bolt 34 extends in parallel with and is equidistant from the rails 30, 30. The screw bolt 34 is supported by bearing subassemblies 38, 39 via ball bearings 36, 36, and 37 wherein the screw bolt 34 is freely rotatable.

A disk-shaped work holder 40 is provided on the front part of the carriage 31 via a bearing 41 such that the work holder 40 is horizontally rotatable. Formed in the upper face of the work holder 40 are two concentric circular grooves 40*a* and 40*b*, the latter 40*b* being smaller than the former 40*a*, and four radial grooves 40*c* through which the groove 40*a* communicates with the groove 40*b*. There are made four air holes in the circular groove 40*b*. These air holes are in communication with a vacuum system (not shown) by way of air passages 42, 43, and 44. A pulley 45 is fixedly provided beneath the work holder 40.

From the front part (right end as viewed in FIG. 5) of the work holder 40 extends a protrusion 40*e*, which is an integral part of the work holder 40. There are provided three bores 46*a*, 46*b*, 46*c* in the protrusion 40*e*. A positioning pin 47 is firmly inserted in the bore 46*a*.

There is a motor 48 provided on the rear part of the work holder 40 in such a manner that the drive shaft 48*a* extends vertically. A pulley 49 locked on the drive shaft 48*a* of the motor 48 is engaged with the pulley 45 via a belt 50. There are grooves 40*f*, 40*f* in the upper face of the carriage 31 which provides passages for the belt 50.

Figure 7:
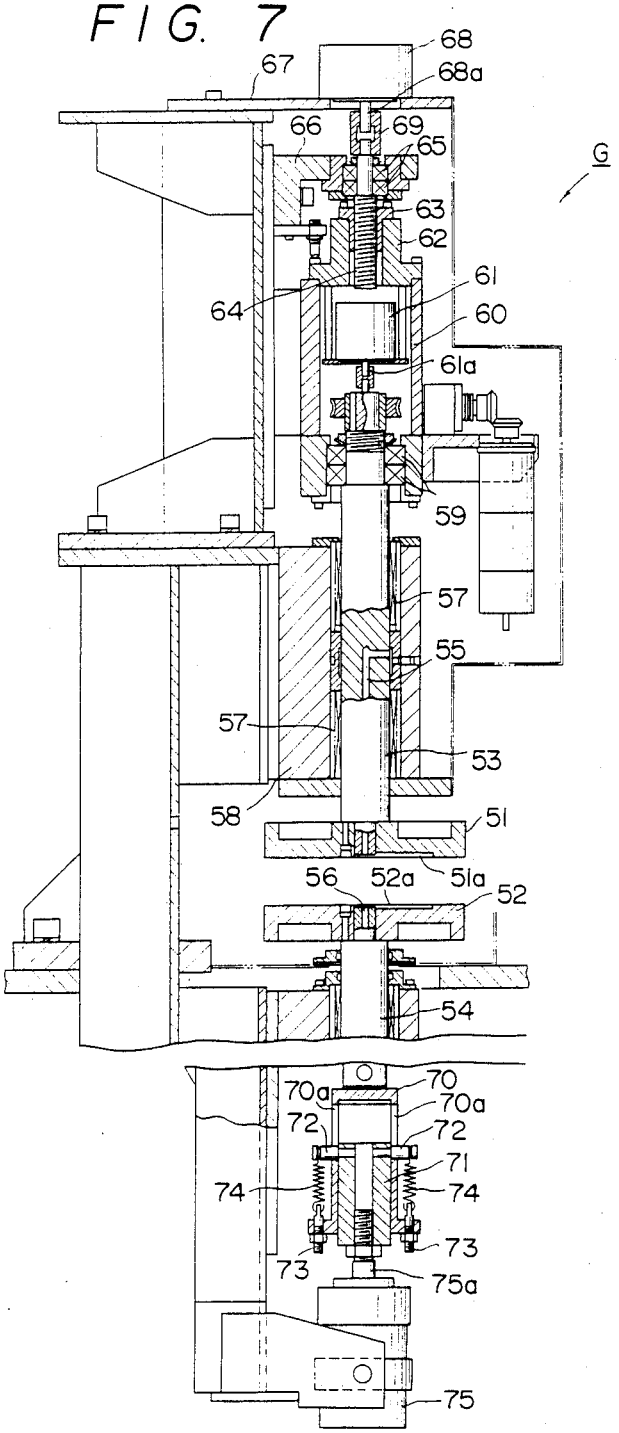
FIG. 7 is a cross section of the work base assembly.

Next, referring to FIG. 7, which is a cross section view, we will explain the mechanism of work holding and conveying means provided on the work base assembly G.

In FIG. 7, reference numerals 51 and 52 designate chuck jigs which are shaped like flanges and capable of holding a work (wafer) between them. The chuck jig 51 is fixed on the lower end of a shaft 53 and the chuck jig 52 on the upper end of a shaft 54. The chuck jigs 51, 52 are horizontally held and are opposed to each other. In the opposing faces of the chuck jigs 51, 52 are made grooves 51*a*, 52*a*, respectively, which are in communication with a vacuum system (not shown) by way of respective air passages 55 and 56 formed in the shafts 53 and 54 for the purpose of facilitating locking of the work by vacuum.

The shaft 53 extends upward through a guide means 58 and is slidable on bearings 57, 57, and the upper end portion of the shaft 53 is rotatably received in a cylindrical housing 60 via bearings 59, 59. The upper end of the shaft 53 is connected to the drive shaft 61*a* of an encoder 61 housed in the cylindrical housing 60.

A flange 62 is fixed on the top of the cylindrical housing 60, and a nut means 63 is fitted in the middle of the flange 62. A screw bolt 64 is threadably received in the nut means 63. The screw bolt 64 is rotatable supported by a support means 66 via bearings 65, 65, and the upper end of the screw bolt 64 is connected by means of a coupling 69 to the drive shaft 68*a* of a motor 68 fixedly provided on a frame 67.

In the similar manner the shaft 54 is related to the same kind of means in its vicinity so that the explanation of them as well as showing them in FIG. 7 is omitted; however, since the means for vertically reciprocating the shaft 54 is not the same as that for reciprocating the shaft 53, we will explain the mechanism of the reciprocating means referring to FIG. 7. Reference numeral 70 designates a cylinder which is fixed on the shaft 53. A piston 71 is inserted in the cylinder 70 such that the piston 71 can freely slide in the cylinder 70. There are provided vertically elongated guide windows 70*a*, 70*a* in the side wall of the cylinder 70. A pair of pins 72, 72 horizontally extend from the upper part of the piston 71 in the opposite directions and pass through the respective windows 70*a*, 70*a*. The pins 72, 73 are therefore guided by the windows 70*a*, 70*a*. A pair of bolts 73, 73 are fixed threadably in a flange formed at the bottom of the cylinder 70. A pair of coil springs 74, 74 are connected between the pins 72, 72 and the bolts 73, 73.

An air cylinder 75 is provided fixedly below the piston 71, and the piston 71 is connected to a rod 75*a* of the air cylinder 75.

Figure 8:
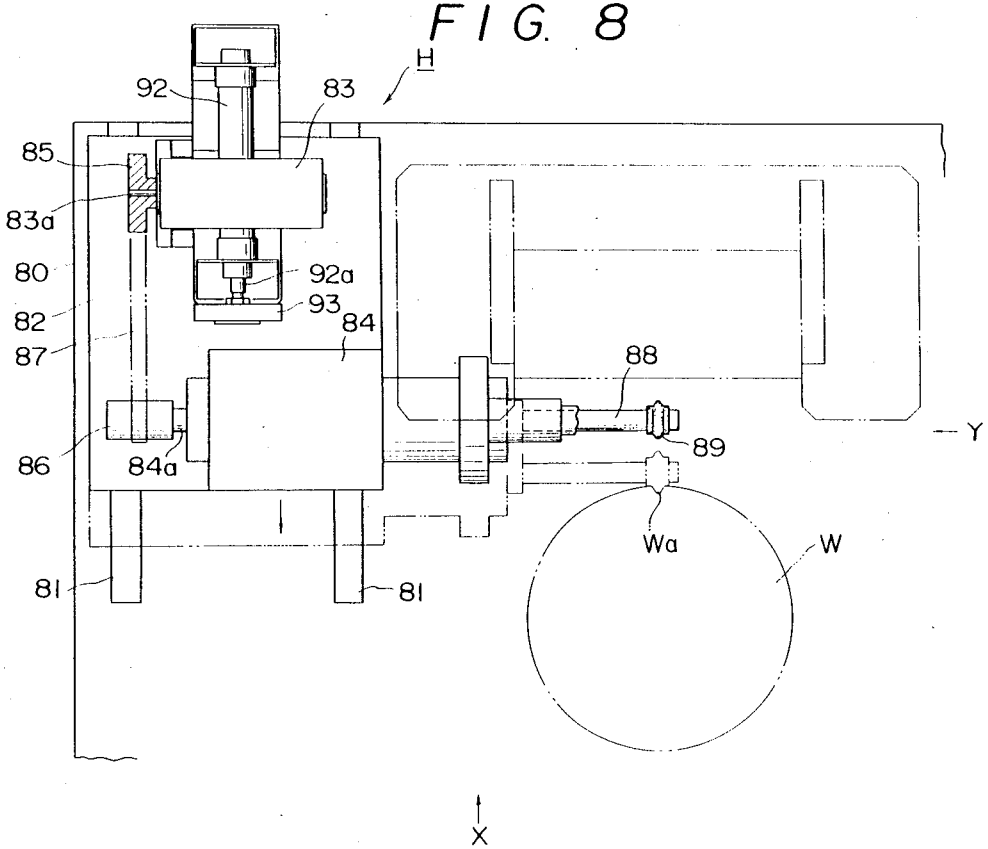
FIG. 8 is a top view of the notch chamfer assembly.
Figure 9:
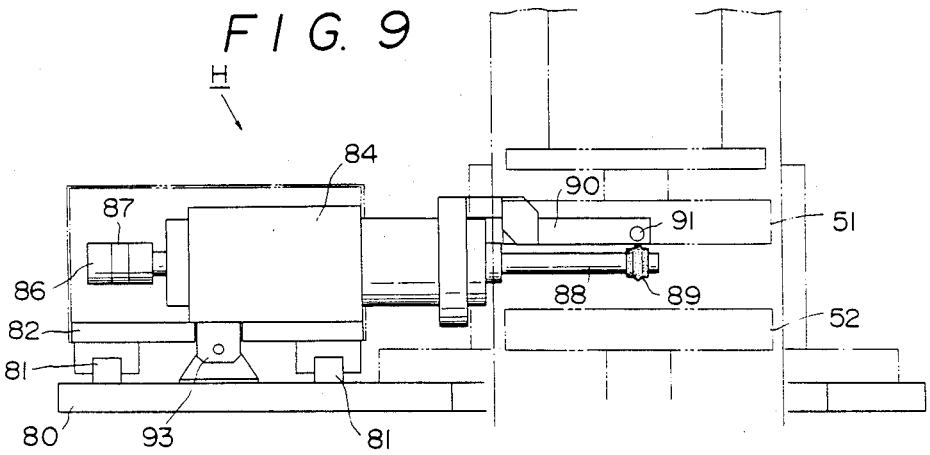
FIG. 9 is a view of the notch chamfer assembly seen from the direction of X in FIG. 8.
Figure 10:
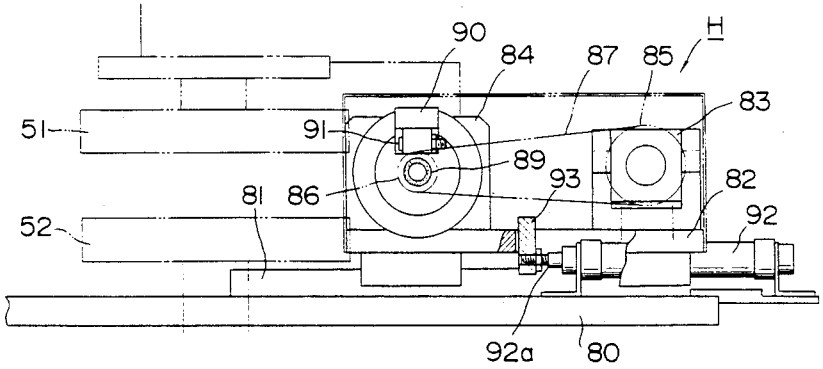
FIG. 10 is a view of the notch chamfer assembly seen from the direction of Y in FIG. 8.

Next, we will explain the notch chamfer assembly H with the help of FIGS. 8, 9, and 10. FIG. 8 is the top view of the notch chamfer assembly H, FIG. 9 is the view of the same seen from the direction indicated by the arrow X in FIG. 8, and FIG. 10 is a view of the same seen from the direction indicated by the arrow Y.

A pair of parallel rails 81, 81 are laid on a stationary base 80 on which runs a movable base 82. A motor 83 and a grinder base 84 are installed on the movable base 82. A pulley 85 locked on the drive shaft 83*a* of a motor 83 is engaged by way of a belt 87 with a pulley 86 locked on the driven shaft 84*a* of the grinder base 84. An abrasive wheel 89 is locked on the spindle 88 of the grinder base 84. An arm 90 extends from the grinder base 84 in parallel with the spindle 88, and a stopper 91 is provided at the end of the arm 90.

An air cylinder 92 is provided in parallel with and equidistant from the rails 81, 81 and the end of the rod 92*a* of the air cylinder 92 is connected to a bracket 93 which is fixed to the movable base 82.

Figure 11:
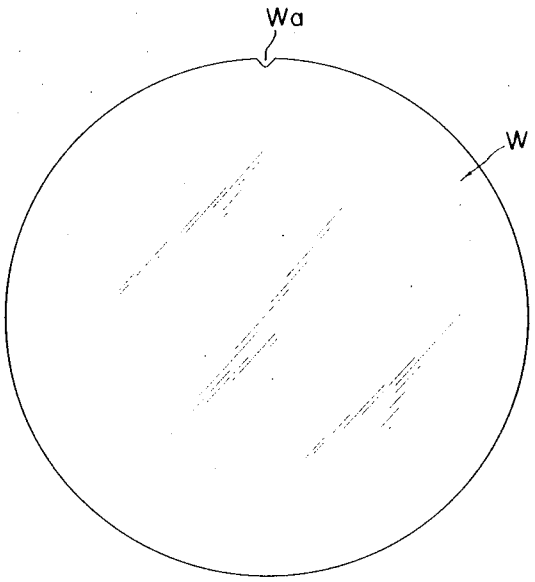
FIG. 11 is a top view of the semiconductor wafer.
Figure 14:
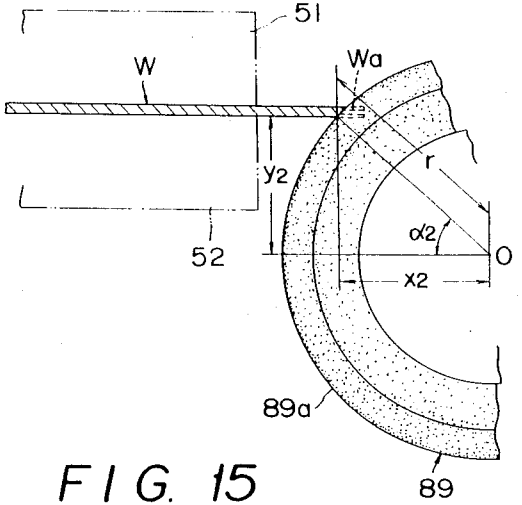
FIG. 14 is a similar view of the abrasive wheel and the wafer as FIG. 13.

So far we have explained the main assemblies of an embodiment of the apparatus for chamfering a notch. A semiconductor wafer W to be machined as the work by the notch chamfering apparatus is prepared in the shape of a thin disk with a V notch Wa cut in the periphery, as shown in FIG. 11.

Figure 12:
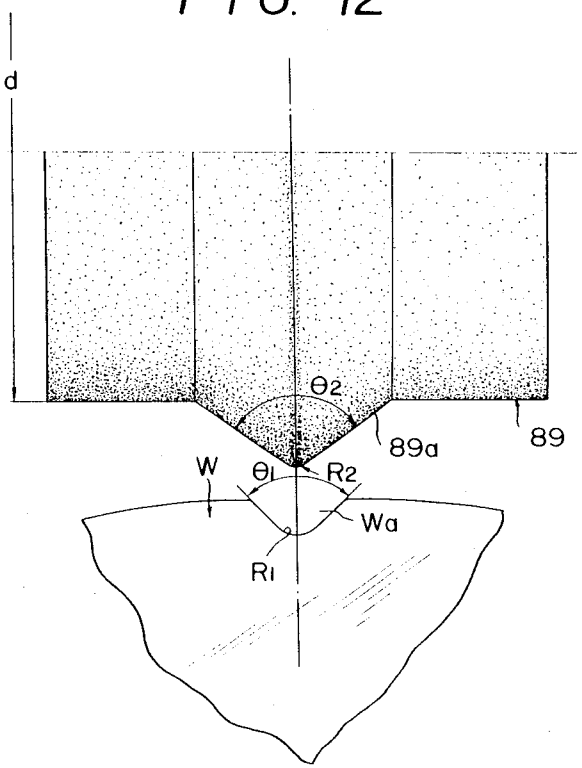
FIG. 12 is a top view of the abrasive wheel and the notch of the wafer.

An expanded view of the V notch Wa and the abrasive wheel 89 are shown in FIG. 12. In the present embodiment, the notch angle $\theta_1$ is 90°, and the curvature $R_1$ of the notch bottom is 1.1 mm. In FIG. 12 it is seen that the abrasive wheel 89 has a swell 89*a* which forms an edge whose maxium diameter d is 20 mm and whose profile seen from any direction in the plane of the edge of the abrasive wheel is V-shaped having an edge angle $\theta_2$ of 140° and the curvature $R_2$ at the tip of the abrasive edge is 1.1 mm. The abrasive wheel 89 is made of diamond grinding stone containing diamond powder-embedded sintered metal.

Next, we will explain the manner of chamfering the V notch of the semiconductor wafer W in the apparatus and method of the invention. In the notch chamfering apparatu shown in FIG. 1, the semiconductor wafers W with a V notch Wa are supplied to the wafer loader assembly A one by one; then they are transported to the thickness measurement assembly B where their thicknesses are measured by a contact-type thickness meter or the like, and if the measured thickness is within a predetermined tolerance range, the wafer is transported to the entrance conveyor assembly C, whereas if the thickness is outside the predetermined tolerance range, the wafer is removed from the line.

The wafer W having reached the entrance conveyor assembly C is then forwarded to a position indicated by the alphabet a where the wafer W is sucked by a handling arm 100 of the handling arm assembly D and, as the handling arm 100 swings through an angle of 90°, the wafer W is carried into the position of the wafer alignment assembly E. The wafer W is aligned here such that the wafer W held by the handling arm 100 stays on the work holder 40 of the wafer feeding assembly F which lies in the middle of the space defined by the aligners 21, 21, which are currently in the open position (two-dot chain line in FIG. 1). The handling arm 100 ceases to such the wafer W whereupon the aligners 21, 21 approach the wafer W until the rubber rollers (only four of them) press the periphery of the wafer W (as shown in solid line in FIGS. 1 and 2) such that the center of the wafer W coincides the center defined by the symmetrical aligners 21, 21. Thus positioned wafer W is immediately sucked to the top face of the work holder 40 by means of the suction effected along the concentric grooves 40*a*, 40*b*, and radial grooves 40*c* (FIG. 4).

Then, the motor 13 of the notch detector 1 (FIGS. 2 and 3) is energized to turn the screw bolt 14, whereby the slider 4 whose nut 12 threadably engaged with the screw bolt 14 is caused to move toward the wafer W until the periphery of the wafer W enters the recess 5*a* of the sensor 5.

At this time the motor 48 of the wafer feeder assembly F is energized and its torque is transmitted to the work holder 40 by way of the pulley 49, belt 50, and pulley 45, whereby the work holder 40 together with the sucked wafer W turns. As the V notch Wa of the wafer W enters the recess 5*a* of the sensor 5, the photoelectric sensors (in this embodiment, the pair of the middle sensor elements) detect the notch Wa. Upon detection of the notch Wa, the turning of the wafer W is stopped after the wafer W has turned 90° further from the moment of detection whereby the notch Wa directly faces the pin 47 and beyond it points toward the work base assembly G. When the notch Wa is thus oriented, the wafer W is released from the work holder 40, and the aligners 21, 21 approach the wafer W until the rubber rollers (only four of them) press the wafer W (as shown in solid line in FIGS. 1 and 2) such that the center of the wafer W coincides the predetermined centering point again. When the wafer W is thus centered, the notch points in the predetermined direction and the positioning pin 47 engages with the notch Wa of the wafer W, and the wafer W is sucked again onto the work holder 40.

Next, the motor 33 (FIGS. 4 and 5) is energized to drive the screw bolt 34 so that the carriage 31 together with the wafer W is caused to move toward the work base assembly G, and the wafer W is placed between the chuck jigs which are currently in the separated positions (FIG. 7). Thereupon, the motor 68 (FIG. 7) is energized to drive the screw bolt 64 to thereby cause the cylindrical housing 60 together with the shaft 53 to descend until the lower face of the chuck jig 51 reaches the upper face of the wafer W, and the chuck jig 51 starts sucking the wafer W. Then, the work holder 40 ceases to suck the wafer W whereby the wafer W is pulled up to the lower face of the chuck jig 51. The motor 68 is energized again but on this occasion it is energized in a manner that the screw bolt 64 is turned reversely whereby the chuck jig 51 ascends. When the ascent of the chuck jig 51 is completed, the motor 33 is energized again (FIGS. 4 and 5) in a manner that the screw bolt 34 turns reversely so that the carriage 31 recedes leaving the wafer W on the chuck jig 51.

Next, the chuck jig 51 descends again simultaneously as the air cylinder 75 (FIG. 7) is driven such that the piston 71 ascends, and as the piston 71 ascends the cylinder 70 and the shaft 54, which are flexibly tethed to the piston 71 by means of the coil springs 74, 74, are caused to ascend until upper face of the chuck jig 52 fixed on the top of the shaft 54 comes in contact with the bottom face of the wafer W. When the wafer W is thus sandwiched between the chuck jigs 51, 52, the piston 71 is raised a little further whereby the chuck jig 52 urged by the coil springs 74, 74 presses the wafer W to the chuck jig 51 so that the wafer W is firmly held between the chuck jigs 51, 52.

Figure 13:
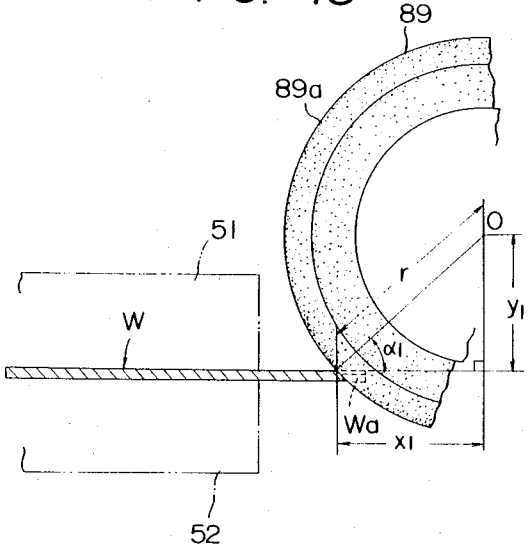
FIG. 13 is a cross-sectional side view of the abrasive wheel and the wafer.

As the wafer W is appropriately set in the work base assembly G, as described above, the motor 83 in the notch chamfering assembly H (FIG. 8) is energized and at the same time the air cylinder 92 is driven. The torque generated by the motor 83 is transmitted to the spindle 88 by way of the pulley 85, the belt 87, the pulley 86, and the driven shaft 84*a*, whereby the spindle 88 spins with the abrasive wheel 89. The air cylinder 92 drives out the rod 92*a* so that the movable base 82 moves away from the air cylinder 92 until it rests in the position indicated by two-dot chain line, whereupon the spinning abrasive wheel 89 touches the wafer W at its notch Wa to chamfer the notch Wa. Incidentally, in this embodiment the apparatus is so designed that the movement of the abrasive wheel 89 is restricted by means of the stopper 91 (FIGS. 9 and 10) which is disposed to hit upon the chuck jig 51 when the movable base 82 arrives in or tries to move beyond the two-dot chain line position. Also the apparatus is so designed that, on this occasion, the center line of the V notch Wa is contained in the same plane as the diameter of the abrasive wheel passing the tip of the edge (FIG. 12), and that the axis of rotation of the the abrasive wheel 89 rests at a level higher than the wafer W (FIG. 13). In this embodiment, the axis of rotation O of the abrasive wheel 89 is 7.07 mm higher than the plane in which the wafer W lies. The altitudinal difference 7.07 mm is calculated from the following equation:

$y_1 = r/2^{\frac{1}{2}}$ where r is the maximum radius of the abrasive wheel 89. In FIG. 13, the angle $\alpha_1$ is 45° and the distance $X_1$ is 7.07 mm ($=y_1$).

Figure 15:
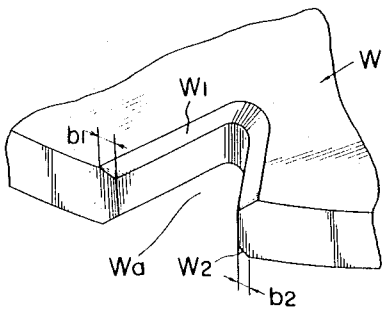
FIG. 15 is a schematic view of the chamfered notch of the wafer. of the wafer.

Since the V-shaped swell 89*a* has a similar edge angle as the acute angle of the V notch Wa, the swell 89*a* fits on the V notch Wa such that the upper corner of the V notch Wa is chamfered at once and evenly, as shown in FIG. 15, where W1 designates the resulting chamfer. The width $b_1$ of the chamfer $W_1$ in this embodiment is 200 to 400 μm.

When the axis of rotation of the abrasive wheel is brought below the level of the wafer W and the same operation as above is repeated, the lower corner of the V notch Wa of the wafer is chamfered. In FIG. 15 the lower corner of the V notch Wa is provided with a chamfer W2 like the chamfer W1. In this embodiment the axis of rotation O of the abrasive wheel 89 is so positioned that $X_2=y_2=7.07$ (mm), and $\alpha_2=45°$. The width $b_2$ of the chamfer $W_2$ is the same as the width $b_1$ of the chamfer $W_1$, namely $b_2=200$ to 400 μm.

In this embodiment, the wafer W as the work is kept stationary during the pre-chamfering aligning operation while the abrasive wheel is moved, but it is possible to arrange such that the abrasive wheel 89 is kept stationary while the wafer W is moved for alignment relative to the abrasive wheel 89 in a manner that the upper and lower corners of the wafer are chamfered successively. Also, the invention is also effectively applicable to the case where the notch made in the wafer is semicircular or the like at its corner profiles. In the case of a semicircular notch, the sectional profile of the edge swell of the abrasive wheel is made semicircular.

If either the semiconductor wafer W or the axis of rotation the abrasive wheel 89 is kept static during chamfering, as is the case with the above embodiment where the abrasive wheel 89 only was on the horizontal move while the wafer W was fixed, the resulting chamfers W1 and W2 on the notch Wa become concaved having a radius of curvature equal to the radius of the circle described by the edge of the abrasive wheel 89. If the semiconductor wafer W and the axis of rotation of the abrasive wheel 89 are both adjustably moved simultaneously in a certain manner during chamfering, it is possible to provide a flat chamfer. It is possible to attain this flat chamfering through employment of a motor in place of the air cylinder 92 appearing in FIGS. 8 and 10 which motor adjustably drives its screw bolt to thereby controls the movement of the movable base 82.

The semiconductor wafer W whose notch Wa has been chamfered is then conveyed to the periphery chamfer assembly I where the upper and lower corners of the periphery are chamfered.

Thus, the semiconductor wafer W chamfered in the apparatus of FIG. 1 is chamfered not only along its round periphery but also at its notch Wa, so that even when its notch Wa is brought in engagement with a positioning pin in such processes as the device manufacturing process, chipping of the notch does not occur and, therefore, the problems which are attributable to chips falling from the semiconductor wafer W are avoided. The problems solved thereby includes contamination of the product devices with the chipped powder, and a crown phenomenon which takes place when an epitaxial layer is grown over the chipped wafer.

By employing the method and the apparatus of the invention in a manner described above, it is possible to effectively chamfer the notch provided at the periphery of a semiconductor wafer such that one contact action completes chamfering of an entire corner of the notch.

According to the present invention, therefore, it is possible to obtain a semiconductor wafer with a notch which resists collisions without being chipped.

What is claimed is:

1. An apparatus for chamfering the notch of a notch-cut semiconductor wafer comprising a positioning means for positioning the semiconductor wafer in a manner that the notch provided in the periphery of the semiconductor wafer points in a predetermined direction; a conveyor means for conveying the thus positioned semiconductor wafer to a chamfering position; a holding means for holding the semiconductor wafer in the chamfering position to bring the wafer to arbitrary places; an abrasive wheel having a swelling edge which is shaped like the notch when seen in a cross section taken on a plane containing the axis of rotation of the abrasive wheel; a driving means for driving the abrasive wheel; and a means for controllingly moving at least one of the two items consisting of the abrasive wheel and the semiconductor wafer, to arbitrary places.

2. An apparatus for chamfering the notch of a notch-cut semiconductor wafer as claimed in claim 1 wherein said abrasive wheel has a swelling edge which is shaped like an alphabetical letter V when seen in a cross section taken on a plane containing the axis of rotation of the abrasive wheel and the edge angle of the edge of the abrasive wheel is such that the edge can fit on one corner of the notch when the edge is brought in contact with the notch in a manner that the axis of rotation of the abrasive wheel is either higher or lower than the plane in which the wafer lies by a predetermined elevation.

3. An apparatus for chamfering the notch of a notch-cut semiconductor wafer as claimed in claim 2, wherein said abrasive wheel has a swelling edge which is shaped like an alphabetical letter V when seen in a cross section taken on a plane containing the axis of rotation of the abrasive wheel and the edge angle of the edge of the abrasive wheel is greater than the angle included in the notch.

* * * * *